United States Patent [19]

Piper

[11] Patent Number: 4,576,333

[45] Date of Patent: Mar. 18, 1986

[54] HEATING SYSTEM

[76] Inventor: James R. Piper, 9581 Featherhill Dr., Villa Park, Calif. 92661

[21] Appl. No.: 289,401

[22] Filed: Aug. 3, 1981

[51] Int. Cl.[4] ..... F24F 7/06; F24F 3/044; F24F 3/08; F24D 5/04

[52] U.S. Cl. ..... 237/49; 165/47; 165/54; 165/57; 98/31

[58] Field of Search ..... 237/19, 46, 16, 69, 237/49; 165/47, 54, 57, 49; 98/31

[56] References Cited

U.S. PATENT DOCUMENTS

| | | | |
|---|---|---|---|
| 209,342 | 10/1978 | Hawley | 237/69 |
| 251,309 | 12/1981 | Spaulding | 237/69 |
| 1,086,031 | 2/1914 | Davis | 165/49 |
| 1,168,304 | 1/1916 | Hellstrom | 165/49 |
| 1,698,763 | 1/1929 | McCauley | 237/46 |
| 2,559,869 | 7/1951 | Gay | 165/104.19 |
| 2,598,842 | 6/1952 | Scott | 165/56 |
| 2,603,140 | 7/1952 | Kehm | 98/31 |
| 2,649,726 | 8/1953 | Wyman | 98/31 |
| 2,811,850 | 11/1957 | Clary | 237/69 |
| 3,148,727 | 9/1964 | Meckler | 165/49 |
| 3,247,895 | 4/1966 | Phillips, Jr. | 165/55 |
| 3,526,361 | 9/1970 | Piper | 237/8 R |
| 3,655,127 | 4/1972 | Piper | 237/13 |
| 3,905,548 | 9/1975 | Brodie | 165/49 |
| 3,999,710 | 12/1976 | Kemmerer | 237/55 |

FOREIGN PATENT DOCUMENTS

| | | | |
|---|---|---|---|
| 2750918 | 5/1979 | Fed. Rep. of Germany | 165/54 |
| 2250076 | 5/1975 | France | 98/31 |

*Primary Examiner*—William R. Cline
*Assistant Examiner*—John K. Ford
*Attorney, Agent, or Firm*—Lyon & Lyon

[57] ABSTRACT

A system for space heating for a building employing structural elements of the building as heating conduits. Girder pairs are employed as manifold conduits and joist pairs are employed as distribution conduits for the present system. The crawl space of the building is used for the return air and becomes a plenum therefor.

2 Claims, 2 Drawing Figures

HEATING SYSTEM

BACKGROUND OF THE INVENTION

The field of the present invention is heating systems for building.

Recent trends in innovative heating for buildings have turned to low temperature systems capable of accommodating such heat sources as solar energy. A major difficulty remaining with such systems is that the initial investment for solar energy equipment as well as the more conventional backup fossil fuel heaters and the like detracts from the advantages of such systems. Consequently, it has been a goal of the progressive alternative energy industry to control initial investment costs and to increase the efficiency of such systems to reduce the required fossil fuel usage.

A space heating system designed with these goals in mind is disclosed in U.S. Pat. Nos. 3,526,361, 3,655,127, 3,844,687 and 3,926,537, to Piper, the disclosures of which are incorporated herein by reference. These earlier systems incorporate frame members of a structure to form conduits through which air is forced by means of a blower. Positioned across the conduit is a heat exchange coil designed to accommodate hot water below the boiling range. Air is drawn in from the space to be heated by the blower, passed through the heat exchange coil and returned to the space. For a building with several rooms, several units, each with its blower and coil were proposed.

In an attempt to reduce initial investment by avoiding the need for conduit, heating systems have attempted to employ the heating of a plenum above or below the occupied space of a building. This plenum is in communication with the various rooms of the building by means of vents through which gravity flow of the heated air could pass. This system significantly reduces the initial investment by removing the cost of the heater conduits. However, it then becomes necessary to heat an additional large space.

To reduce the demand on heating systems, insulation has been employed in ceilings and walls. In homes not built on slabs, insulation has also been found beneficial beneath floors because of the requirement that the crawl space beneath such buildings be vented. As crawl spaces must be vented, they are generally found to be at or near the outside ambient temperature. It is for this reason that such insulation under the floor has been required in areas experiencing extreme cold during periods of the year.

SUMMARY OF THE INVENTION

The present invention is directed to an improved space heating system which in one aspect of the invention employs the crawl space beneath the floor in a building as the return plenum for the space heating system. By employing the crawl space in such a manner, a reduction in the initial investment for conduits is realized and yet an even flow and exhaust throughout the structure is attained. Employment of the crawl space also removes the need for insulation beneath the floor in such buildings as the returning air is generally warm. However, the space does not require temperature maintenance at the same level as the dwelling itself which would result in lost heat.

Employment of the crawl space as a return plenum also is benefical because the required venting of such a space is accomplished by venting into the house rather than into the outside environment. Cold air is therefore not continually supplied to the underside of the flooring. To further increase efficiency, insulation and sealing may be provided about the stem wall. The amount of insulation required to insulate the stem wall is far less than that required to cover the underside of the floor.

In another aspect of the present invention, the structural members supporting the building are employed as feed conduits for the heating system. The present invention contemplates the use of both spaced joists and spaced girders for this purpose such that a single manifold conduit may be employed with distribution conduits to distribute heat to the entire building. By using a first manifold conduit, located between girders, a single blower and a single heat exchange coil may be employed. Such an arrangement reduces the number of blower and coil units otherwise required if the system employed individual units in individual pairs. Thus, initial investment is reduced because of the advantageous use of structural members for conduits and through the use of single blower and coil units.

Thus, an object of the present invention is to provide an improved space heating system. Other and further objects and advantages will appear hereinafter.

BRIEF DESCRIPTION OF THE PREFERRED EMBODIMENT

Figure 1:
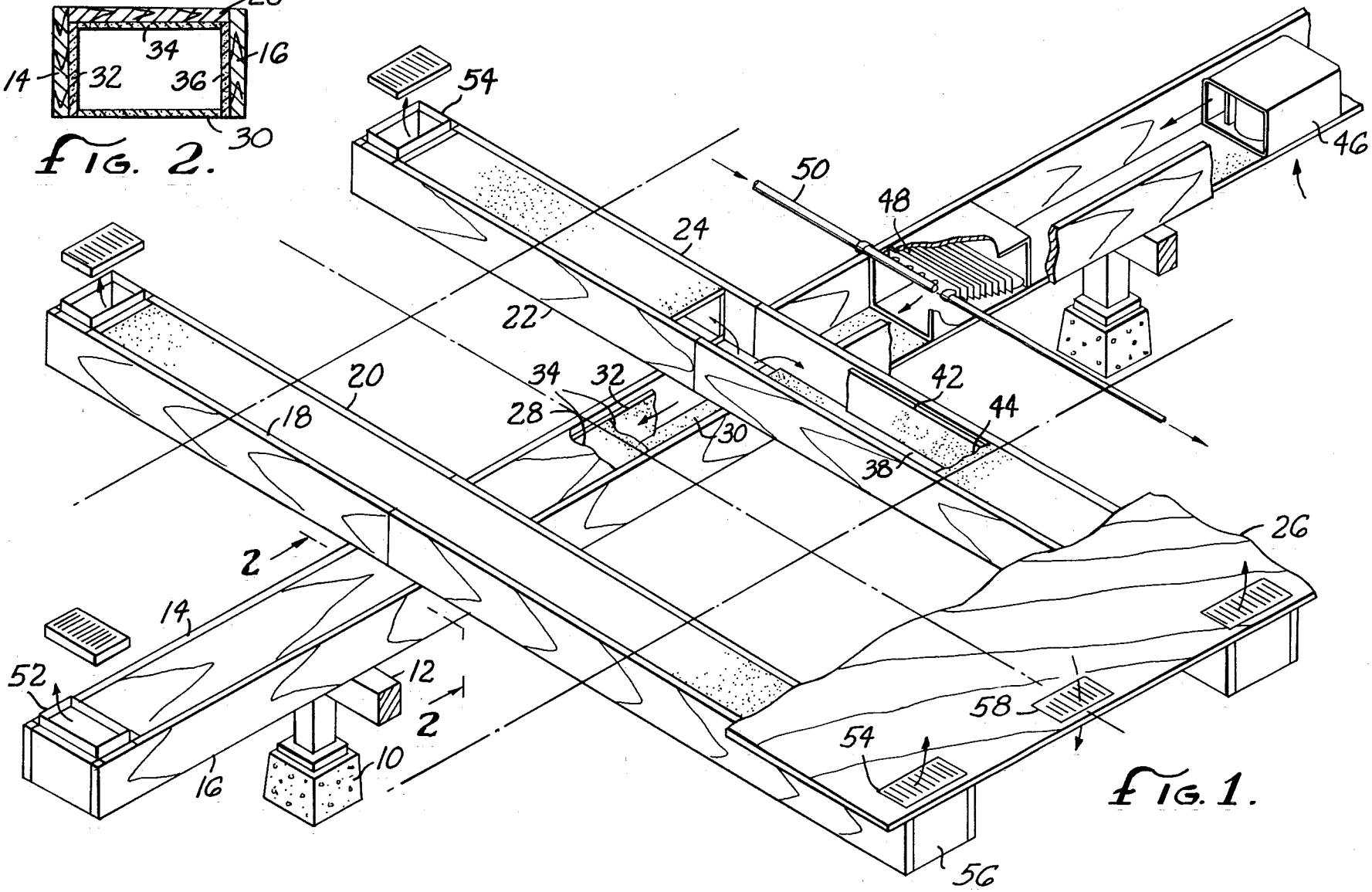
FIG. 1 is a perspective schematic view of a system of the present invention.

Turning in detail to the drawings, a space heating system is disclosed in cooperation with a building employing conventional spaced joists for supporting a floor and spaced girders supporting the joists. Specifically, the building structure is shown to include footings 10 located in the crawl space beneath the floor of a building. Supported on the footings 10 are T-blocks 12 which in turn support girders 14 and 16. The girders are arranged in pairs on the T-Blocks 12 as can be seen in FIG. 1. Located above the girders 14 and 16 are joists 18, 20, 22, and 24. It is to be understood that additional joists and additional girders not specifically employed with the present invention are positioned in a like manner beneath the building. Of course, the arrangement of the joists and girders employed may also be varied to supply heat to varying floor plans. A floor 26 is supported by the several joists. A conventional stem wall (not shown) is also employed in the building structure and is sealed and preferably insulated.

Figure 2:
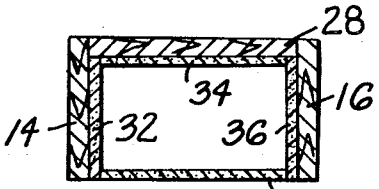
FIG. 2 is a cross-sectional view taken along line 2—2 of FIG. 1.

To define a manifold conduit between a girder pair, panels 28 and 30 are employed. The panels 28 and 30 extend between the girders 14 and 16 to create a conduit of rectangular cross-section as can best be seen in FIG. 2. To increase efficiency, insulating sheets 32, 34, and 36 are also employed. The lower panel 30 and the insulating sheets 32, 34 and 36 may be conveniently of wallboard. The additional wooden panel 28 gives added strength to the conduit where it is likely to be needed and increases the heat retention within the conduit.

The distribution conduits defined between the joists 18, 20, 22 and 24 are similarly formed through the use of a lower panel 38 and the floor 26. Insulating sheets 40, 42, 44 are employed as in the manifold conduit. At the juncture of each of the distribution conduits with the manifold conduit, the lower panel 38 of the distribution conduits and the upper panel 28 and insulating sheet 34 are discontinued to provide full, unimpeded communication between the manifold conduit and the distribution conduits. Thus, air flow from the manifold conduit can be distributed to points along the distribution conduits as illustrated by the arrows in FIG. 1.

An inlet (not visible) is located through the lower panel 30 of the manifold conduit to provide air from the crawl space into the conduit system. A blower 46 is located on the inlet to draw air into the conduit system and force that air along the manifold conduit. Located between the blower and any exit from the manifold conduit is a heat exchange coil 48. The heat exchange coil 48 is designed to provide maximum contact with the air forced therethrough by the blower 46. Hot water is provided through tube 50 in the range of 130° F. In this way, air drawn in from the crawl space of the building by the blower 46 is heated to an adequate temperature for heating the occupied space of the building.

From the coil 48, the heated air passes into the distribution conduits or, if included, to any outlets 52 located along the manifold conduit. The outlet 52 may be positioned to allow communication from the distribution conduit through the floor of the building for heating purposes. Similarly, the distribution conduits include outlets 54 which also convey heated air into the building space. End caps 56 are employed where appropriate to prevent heated air from being directed to locations other than desired.

Return vents 58 may be located about the building through the floor 26 to return air to the plenum formed by the crawl space for reintroduction into the intake beneath the blower 46. As stated above, the crawl space is to be sealed so that venting of the crawl space occurs only into the building and heat is retained to help reduce heat loss from the occupied areas of the building.

Thus, an improved space heating system is disclosed While embodiments and applications of this invention have been shown and described, it would be apparent to those skilled in the art that many more modifications are possible without department from the inventive concepts herein described. The invention, therefore, is not to be restricted except by the spirit of the appended claims.

What is claimed is:

1. A centralized warm air heating system for heating a building having a crawl space beneath the floor which forms a return plenum spaced joists supporting the floor and spaced girders supporting the joists, comprising first panels extending between two of the spaced girders to form a manifold conduit between the spaced girders;

second panels extending between at least two of the spaced joists to form distribution conduits between the spaced joists, said manifold conduit and said distribution conduits being in communication for airflow therebetween;

at least one inlet from the crawl space beneath the floor into said manifold conduit;

outlets from said distribution conduits to the building through the floor;

return vents through the floor from the building to the crawl space beneath the floor;

blower means to force air from said inlet to said outlets; and a heat exchange coil positioned across said manifold conduit.

2. The space heating system of claim 1 further comprising a plenum defined by the space beneath the floor, said plenum being substantially sealed but for said inlet and said return vents.

* * * * *